US006715469B2

(12) United States Patent
Ishimoto

(10) Patent No.: US 6,715,469 B2
(45) Date of Patent: Apr. 6, 2004

(54) ACCUMULATOR FUEL INJECTION SYSTEM

(75) Inventor: Masayori Ishimoto, Saitama Prefecture (JP)

(73) Assignee: Bosch Automotive Systems Corporation (JP)

( * ) Notice: Subject to any disclaimer, the term of this patent is extended or adjusted under 35 U.S.C. 154(b) by 0 days.

(21) Appl. No.: 10/408,864

(22) Filed: Apr. 7, 2003

(65) Prior Publication Data

US 2003/0192509 A1 Oct. 16, 2003

(30) Foreign Application Priority Data

Apr. 10, 2002 (JP) ..... 2002-107976

(51) Int. Cl.[7] ..... F02M 37/04
(52) U.S. Cl. ..... 123/446; 123/541; 123/447
(58) Field of Search ..... 123/446, 447, 123/541, 456, 514, 198 D, 467

(56) References Cited

U.S. PATENT DOCUMENTS 4,417,557 A * 11/1983 Walter ..... 123/467
4,449,507 A * 5/1984 Mayer ..... 123/467
5,622,152 A * 4/1997 Ishida ..... 123/446
5,731,515 A * 3/1998 Tominaga et al. ..... 73/119 A
5,732,679 A * 3/1998 Takahasi et al. ..... 123/467
5,878,618 A * 3/1999 Stalzer ..... 72/452.9
6,112,727 A * 9/2000 Cristiani et al. ..... 123/514
6,131,549 A * 10/2000 Onishi ..... 123/495
6,253,734 B1 * 7/2001 Rembold et al. ..... 123/446
6,253,735 B1 * 7/2001 Miyajima ..... 123/456

* cited by examiner

*Primary Examiner*—Carl S. Miller
(74) *Attorney, Agent, or Firm*—Ostrolenk, Faber, Gerb & Soffen, LLP

(57) ABSTRACT

An object of the present invention is to provide an accumulator fuel injection system comprising a pressure increasing unit 7 and a pressure increasing common rail 6, in which leaked fuel is recirculated from a high pressure side to a low pressure side, and which is capable of reducing the amount of fuel that must be delivered under pressure by a low pressure pump 3. The focus of the present invention is to return high pressure leaked fuel to between the low pressure pump 3 and a high pressure pump 5. The accumulator fuel injection system of the present invention comprises the low pressure pump 3 for delivering fuel under pressure from a fuel tank 2, the high pressure pump 5 for changing the fuel from the low pressure pump 3 into high pressure fuel, an accumulator (common rail) 6 for accumulating the high pressure fuel from the high pressure pump 5 at a predetermined pressure, an injector 8 which is connected to the accumulator 6 for injecting the high pressure fuel, and the pressure increasing unit 7 which is provided between the injector 8 and the accumulator 6 for further increasing the pressure of the high pressure fuel. Leaked fuel from the pressure increasing unit 7 may be recirculated to the downstream side of the low pressure pump 3 through a unit leakage passage 17.

3 Claims, 2 Drawing Sheets

ACCUMULATOR FUEL INJECTION SYSTEM

BACKGROUND OF THE INVENTION

1. Field of the Invention

The present invention relates to an accumulator fuel injection system, and more particularly to an accumulator fuel injection system which enables the accumulation and injection of high pressure fuel.

2. Description of the Related Art

A conventional accumulator fuel injection system is typically provided with, for example, a low pressure pump (low pressure fuel supply pump) which delivers fuel under pressure from a fuel tank, a high pressure pump (fuel injection device) which changes the fuel from the low pressure pump into high pressure fuel, an accumulator (common rail) which accumulates the high pressure fuel from the high pressure pump at a predetermined pressure, an injector which is connected to the accumulator and which injects the high pressure fuel, and a pressure increasing unit which is provided between the injector and the accumulator and which further increases the pressure of the high pressure fuel. A common rail comprising a pressure increasing unit is known as a pressure increasing common rail.

This pressure increasing unit and pressure increasing common rail employ a piston system, for example, in which the pressure of the fuel from the high pressure pump is increased in accordance with the area ratio between the pressure increasing side at which the piston has a large diameter and the pressure increase receiving side at which the piston has a small diameter, whereupon the fuel is supplied to an accumulator for high pressure fuel injection.

When this pressure increasing operation is performed using fuel from the high pressure pump, leaked fuel is returned from the fuel increasing unit and the injector to the low pressure side (a fuel tank at atmospheric pressure), and the amount of fuel recirculation that must be performed is large, for example a recirculation amount of up to three times the amount of injected fuel.

Hence in an accumulator fuel injection system comprising this type of fuel increasing unit, a problem arises regarding leaked fuel from the pressure increasing unit in that a large capacity high pressure pump and low pressure pump must be provided in order to recirculate a large amount of fuel from the low pressure side to the high pressure side.

Furthermore, leaked fuel from the pressure increasing unit and the injector reaches extremely high temperatures and if left as is, may damage the high pressure pump and so on. Further problems include the fact that changes in the kinematic viscosity of the fuel caused by temperature change may contribute to changes in the injection amount.

SUMMARY OF THE INVENTION

The present invention has been designed in consideration of such problems, and it is an object thereof to provide an accumulator fuel injection system which is capable of recirculating leaked fuel from a high pressure side to a low pressure side.

Another object of the present invention is to provide an accumulator fuel injection system which comprises a fuel increasing unit and a fuel increasing common rail and which is capable of reducing the amount of fuel that must be delivered under pressure by a low pressure pump.

A further object of the present invention is to provide an accumulator fuel injection system in which a low pressure fuel supplying pump does not have to be increased in size in order to recirculate large amounts of leaked fuel from the fuel increasing unit.

A further object of the present invention is to provide an accumulator fuel injection system which is capable of cooling the temperature of leaked fuel from the fuel increasing unit, injector, and so on.

More specifically, the object of the present invention is to return high pressure leaked fuel between a low pressure pump and a high pressure pump, and also to cause a filter for leaked fuel to function doubly as a cooling device. The present invention is an accumulator fuel injection system comprising a low pressure pump for delivering fuel under pressure from a fuel tank, a high pressure pump for changing the fuel from the low pressure pump into high pressure fuel, an accumulator for accumulating the high pressure fuel from the high pressure pump at a predetermined pressure, an injector which is connected to the accumulator for injecting the high pressure fuel, and a pressure increasing unit which is provided between the injector and the accumulator for further increasing the pressure of the high pressure fuel. This accumulator fuel injection system enables leaked fuel from the pressure increasing unit to be recirculated to the downstream side of the low pressure pump through a unit leakage passage.

A main filter is provided on a low pressure fuel passage between the low pressure pump and the high pressure pump, and the unit leakage passage may be connected to the low pressure fuel passage between the low pressure pump and the main filter.

The main filter is provided on the low pressure fuel passage between the low pressure pump and the high pressure pump, the unit leakage passage is connected between the main filter and the high pressure pump, and a cooling filter unit may be provided on the unit leakage passage.

A mechanism, such as an air cooling system or a water cooling system, may be employed at will as the leaked fuel cooling system used in the cooling filter unit.

In the accumulator fuel injection system according to the present invention, high pressure leaked fuel is returned between the low pressure pump and high pressure pump, or in other words leaked fuel is refluxed to the downstream side of the low pressure pump, and as a result the amount of fuel that must be delivered from the low pressure pump toward the high pressure pump can be reduced. Thus, even with a pressure increasing common rail, the capacity of the low pressure pump does not have to be increased.

Further, by causing the leaked fuel filter provided on the unit leakage passage to function doubly as a cooling device, leaked fuel can be cooled to reduce the temperature thereof and thereby avoid adverse effects on the system as a whole.

DESCRIPTION OF THE PREFERRED EMBODIMENTS

An accumulator fuel injection system 1 according to a first embodiment of the present invention will now be described on the basis of FIG. 1.

Figure 1:
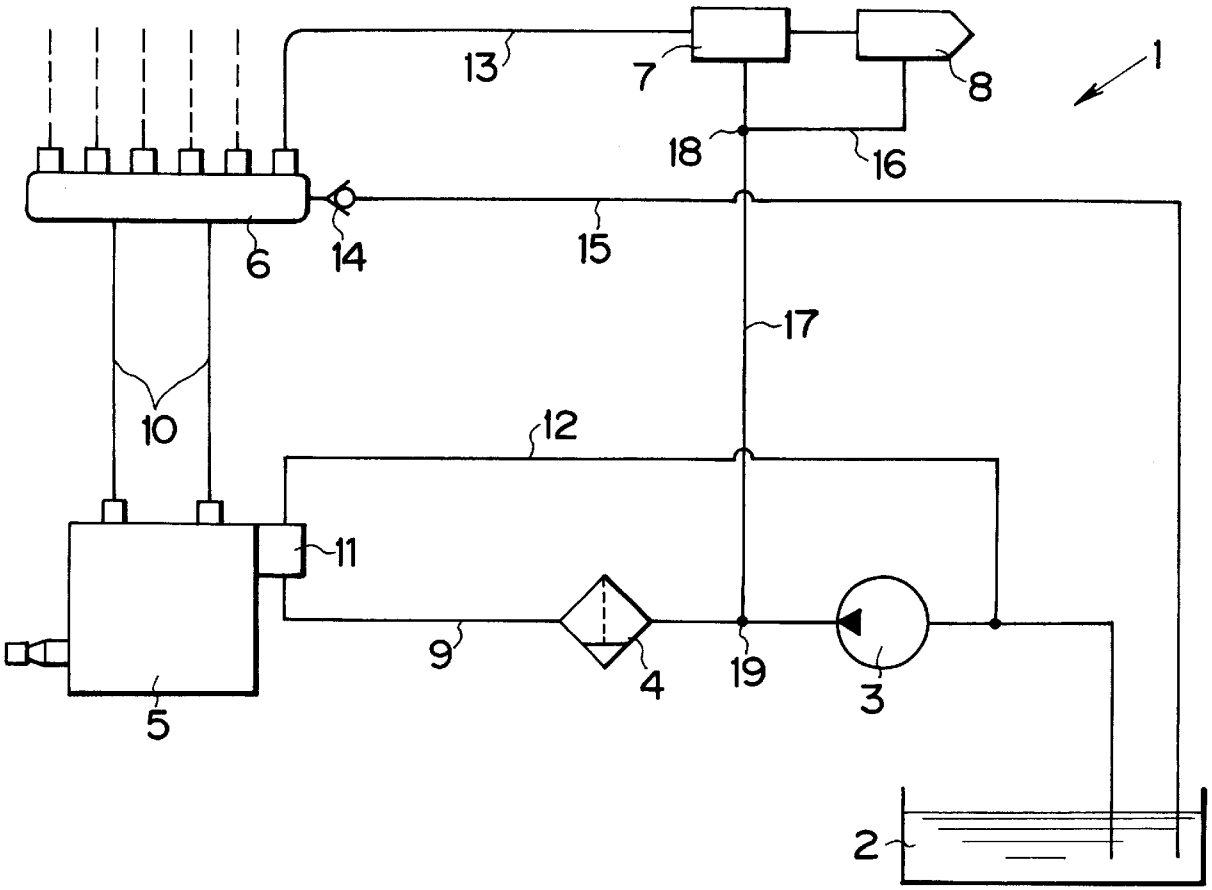
FIG. 1 is a schematic diagram illustrating an accumulator fuel injection system 1 according to a first embodiment of the present invention.

FIG. 1 is a schematic diagram illustrating the accumulator fuel injection system 1. This accumulator fuel injection system 1 comprises a fuel tank 2, a low pressure pump 3 (low pressure fuel supplying pump), a main filter 4, a high pressure pump 5 (fuel injection device), a common rail 6 (accumulator), a pressure increasing unit 7, and a plurality of injectors 8 (of which only one is illustrated in the example in the drawing).

The low pressure pump 3 is driven by an electric motor or the like to pass fuel from the fuel tank 2 through a low pressure fuel passage 9 and supply the fuel to the high pressure pump 5 via the main filter 4.

The main filter 4 filters waste and dust in the fuel.

The high pressure pump 5 is driven by an engine or the like, and changes low pressure fuel from the low pressure pump 3 into high pressure fuel which is supplied to the common rail 6 through a high pressure fuel passage 10.

The high pressure pump 5 is provided with a throttle metering unit 11 which adjusts the amount of fuel supplied to the high pressure pump 5 and returns surplus fuel to the upstream side of the low pressure pump 3 through a metering leakage passage 12.

The common rail 6 accumulates the high pressure fuel from the high pressure pump 5 in a predetermined amount and at a predetermined pressure, thereby allowing high pressure fuel to be supplied to the pressure increasing unit 7 and injector 8 through a high pressure fuel discharge passage 13 in accordance with the fuel injection performed by the injector 8.

The common rail 6 is provided with a pressure adjustment valve 14 which maintains the pressure inside the common rail 6 at a predetermined level and is capable of refluxing leaked fuel to the fuel tank 2 through a common rail leakage passage 15.

As described above, the pressure increasing unit 7 increases the pressure of fuel from the common rail 6 in accordance with the projected area ratio depending to differences in the piston diameter, for example, and is capable of supplying the injector 8 with this fuel such that the fuel is injected from the injector 8 at a predetermined timing.

Leaked fuel from the injector 8 passes through an injector leakage passage 16, merges with leaked fuel from the pressure increasing unit 7 at a confluence 18 with a unit leakage passage 17, and returns to the low pressure fuel passage 9 (reflux point 19) between the low pressure pump 3 and main filter 4.

In the accumulator fuel injection system 1 constructed in this manner, leaked fuel from the pressure increasing unit 7 and injector 8 is returned through the unit leakage passage 17 to the reflux point 19 on the low pressure fuel passage 9 downstream of the low pressure pump 3, and thus recirculated fuel is returned to the original fuel delivery system such that the amount of fuel which must be delivered by the low pressure pump 3 can be reduced.

Hence even if a large amount of leaked fuel must be recirculated due to the equipment installed in the pressure increasing unit 7, the performance of the low pressure pump 3 may be kept at a minimum and the capacity thereof does not have to be increased. As a result, increases in the size and cost of the accumulator fuel injection system 1 can be avoided.

Figure 2:
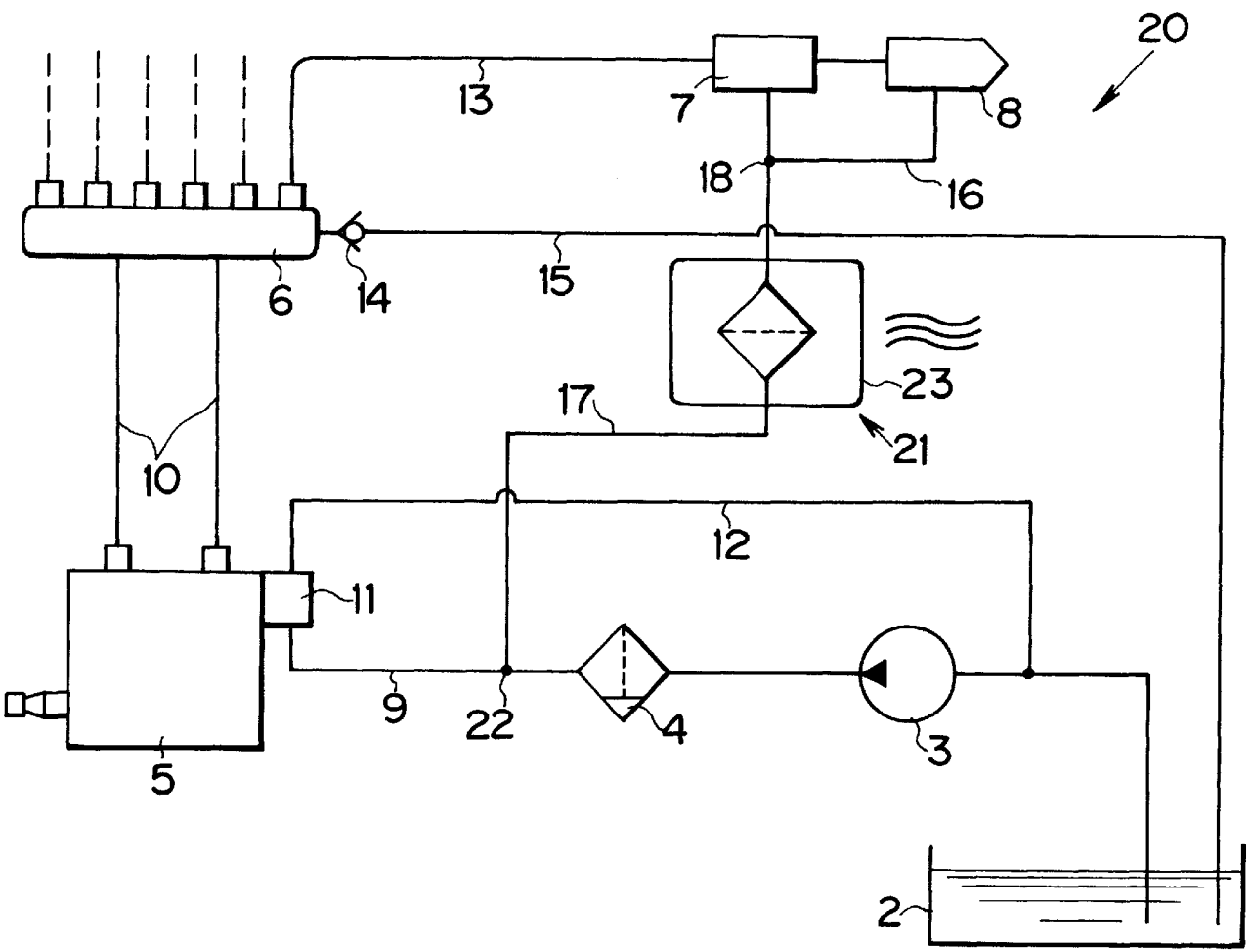
FIG. 2 is a schematic diagram illustrating an accumulator fuel injection system 20 according to a second embodiment of the present invention.

FIG. 2 is a schematic diagram illustrating an accumulator fuel injection system 20 according to a second embodiment of the present invention. Identical parts to FIG. 1 have been allocated the same reference numerals. In the accumulator fuel injection system 20, a cooling filter unit 21 is provided on the unit leakage passage 17, and the unit leakage passage 17 is provided so as to return to the low pressure fuel passage 9 (reflux point 22) between the main filter 4 and the high pressure pump 5.

In other words, the unit leakage passage 17 is returned to the reflux point 22 downstream of the main filter 4, and thus the fuel flow rate is reduced not only through the low pressure pump 3 but also through the main filter 4 such that the capacity and size of the filter can be reduced and the capacity of the main filter 4 itself can be limited. In actual fact, the main filter 4 receives the delivery pressure from the low pressure pump 3, and therefore the main filter 4 must be manufactured in a small size to minimize pressure loss and also for installment in a vehicle or the like. Hence it is difficult to enlarge the size of the main filter 4.

All of the fuel which flows into the high pressure pump 5 must be filtered, and since the unit leakage passage 17 is connected to the reflux point 22 downstream of the main filter 4, the reflux cooling filter unit 21 is provided on the unit leakage passage 17.

In the accumulator fuel injection system 20 constructed in this manner, the cooling filter unit 21 has both a filtering function and a cooling function and is capable of cooling high temperature leaked fuel.

This leakage cooling filter unit 21 has a large maximum fuel transmission capacity but low pressure, and the influence of pressure loss thereon is negligible. Hence there is a large degree of freedom in the constitution thereof.

Accordingly, the surface area of the cooling filter unit 21 may be enlarged by providing fins (not shown) on the outer surface of a filter case 23 such that the cooling filter unit 21 is air cooled, or cooling water may be led through the interior and exterior of the filter case 23 such that the cooling filter unit 21 is water cooled.

By providing the cooling filter unit 21 on the unit leakage passage 17 side, the need for development of the main filter 4 to be resistant to high pressure, have a large capacity, low pressure loss, and so on is eliminated, and by connecting the unit leakage passage 17 to the low pressure fuel passage 9 between the main filter 4 and the high pressure pump 5, the load on the low pressure pump 3 can be reduced.

According to the present invention as described above, in an accumulator fuel injection system having a common rail which is provided with a pressure increasing unit, leaked fuel from the pressure increasing unit is led to the downstream side of a low pressure pump, and therefore size increases in the low pressure pump can be avoided.

Further, by leading the leaked fuel from the pressure increasing unit to the downstream side of a main filter and providing a cooling filter unit on a unit leakage passage, size increases in the main filter can also be avoided.

What is claimed is:

1. An accumulator fuel injection system comprising:

a low pressure pump for delivering fuel under pressure from a fuel tank;

a high pressure pump for changing the fuel from the low pressure pump into high pressure fuel;

an accumulator for accumulating the high pressure fuel from the high pressure pump at a predetermined pressure;

an injector which is connected to the accumulator for injecting the high pressure fuel; and a pressure increasing unit which is provided between the injector and the accumulator for further increasing the pressure of the high pressure fuel, wherein leaked fuel from the pressure increasing unit may be refluxed to the downstream side of the low pressure pump through a unit leakage passage.

2. The accumulator fuel injection system according to claim 1, wherein a main filter is provided on a low pressure fuel passage between the low pressure pump and the high pressure pump, and the unit leakage passage is connected to the low pressure fuel passage between the low pressure pump and the main filter.

3. The accumulator fuel injection system according to claim 1, wherein the main filter is provided on the low pressure fuel passage between the low pressure pump and the high pressure pump;

the unit leakage passage is connected between the main filter and the high pressure pump; and a cooling filter unit is provided on the unit leakage passage.

* * * * *